United States Patent [19]

Yamamoto

[11] Patent Number: 4,714,286

[45] Date of Patent: Dec. 22, 1987

[54] AUXILIARY LOCKING MECHANISM FOR A CASE

[76] Inventor: Ken Yamamoto, 22-5 4 chome, Nishisakado Sakado-shi, Saitama-ken, Japan

[21] Appl. No.: 760,057

[22] Filed: Jul. 29, 1985

Related U.S. Application Data

[63] Continuation of Ser. No. 406,475, Aug. 9, 1982, abandoned.

[30] Foreign Application Priority Data

Aug. 25, 1981 [JP] Japan ..... 56-125402
May 24, 1982 [JP] Japan ..... 57-75995

[51] Int. Cl.[4] ..... E05C 17/24

[52] U.S. Cl. ..... 292/263; 292/252; 292/338; 292/270

[58] Field of Search ..... 292/263, 262, 252, 129, 292/338, 339, 278, 270; 217/60; 189/70

[56] References Cited

U.S. PATENT DOCUMENTS

| | | | |
|---|---|---|---|
| 936,992 | 10/1909 | Frank | 292/263 |
| 1,967,592 | 7/1934 | Rawlings | 292/263 |
| 2,792,917 | 5/1957 | Smith et al. | 189/7 |
| 3,093,258 | 6/1963 | Turner | 217/60 |
| 4,346,924 | 8/1982 | Herriott | 292/129 |

*Primary Examiner*—Richard E. Moore
*Attorney, Agent, or Firm*—Donald D. Mon

[57] ABSTRACT

An auxiliary locking mechanism for a bag or a case especially an attache case, a cupboard etc. having a rigid body and lid for opening and closing the body. The auxiliary locking mechanism provided restricts or limits the opening of the lid at a position particularly when the case is vertical so as to prevent spilling of articles contained in the case due to inadvertent opening of the lid. However, the auxiliary locking mechanism releases the lid when the case is in the horizontal position to allow the lid to open completely.

10 Claims, 10 Drawing Figures

AUXILIARY LOCKING MECHANISM FOR A CASE

FIELD OF THE INVENTION

This invention relates to an auxiliary locking mechanism for a case, such as an attache case comprised of a rigid material; a cupboard, etc.

BACKGROUND OF THE INVENTION

Heretofor, attache cases made of a rigid material such as aluminum alloy, plastic, etc. consist of a body, a lid hinged to the body, a handle at the middle part of the upper face of the body and a main locking mechanism for the lid. However in the conventional device, it is necessary to have the case horizontal to open the lid completely and both hands are needed for opening the case when it is vertical. If the lid is opened when the case is vertical, articles in the case may push the lid by by force of gravity to a completely open position as soon as the main locking is released causing the articles to fall out of the case.

BRIEF DESCRIPTION OF THE INVENTION

The object of the invention is to provide an auxiliary locking mechanism for a bag, case, etc. which prevents the complete opening of the lid of a bag, case, etc. when opened in the vertical position and complete scattering of the articles in the case, etc. The auxiliary locking mechanism locks the lid in a half opened position so that one can open the case with one hand when the case is in the vertical or standing position.

Another object of the invention is to provide an auxiliary locking device which operates in the locking position or releasing position by gravity force. For example, in the vertical position, auxiliary lock prevents the lid from opening and restricts the lid opening whereas, in a horizontal position the lock is released and allows complete opening of the lid.

DETAILED DESCRIPTION OF THE INVENTION

Figure 1:
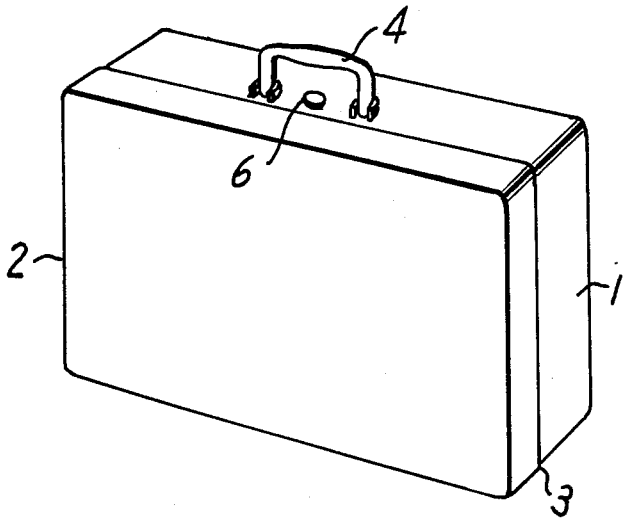
FIG. 1 is a perspective view of a attache case according to a first embodiment of this invention.
Figure 2:
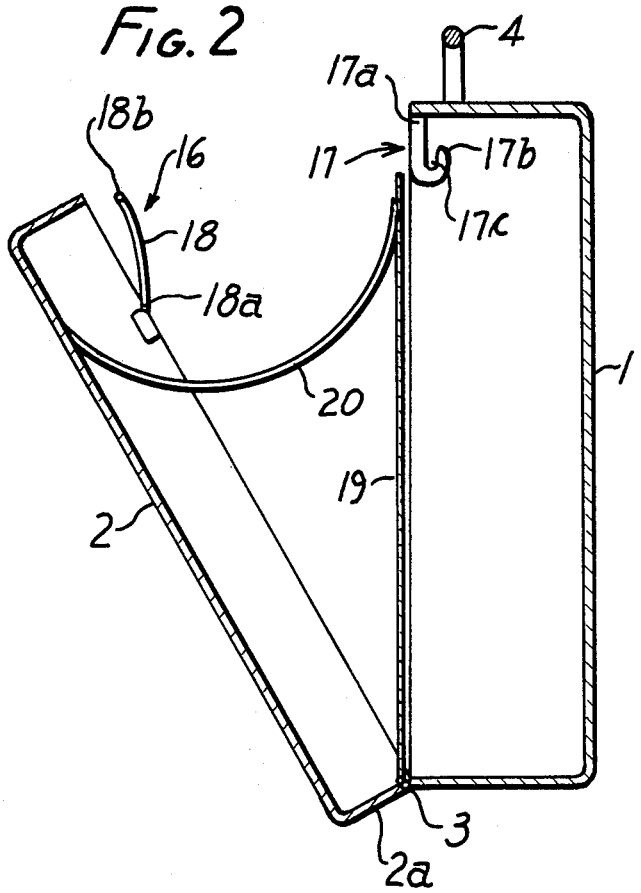
FIG. 2 is a longitudinal cross sectional view of the attache case of FIG. 1.
Figure 3:
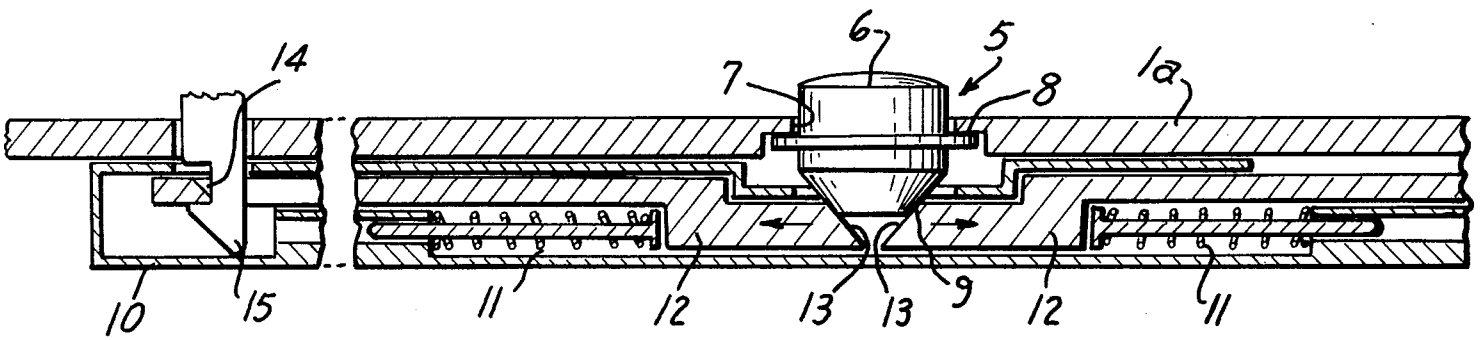
FIG. 3 is an enlarged cross sectional view of the main locking mechanism in which a portion of the left side rotated 90 degrees.

FIGS. 1 through 3 show an embodiment of the present invention which comprises a body 1 of substantiated depth having a lid 2 of substantially shallow depth, which may consist of aluminum alloy, connected by a hinge 3 to each other so as to open and close at the bottom. There is a handle 4 provided at a middle part of the upper body 1 and a main locking mechanism 5 for locking the lid 2. The main locking mechanism 5 has an operating button 6 for releasing the locking parts at the right and left as shown in FIG. 3. Thc button 6 and flange 8 are inserted into a bore 7 in the upper face 1*a* of body 1. The flange 8 engages the inner rim of bore 7 so as to prevent the escape of button 6. The button 6 has a tapered face 9 at its inner periphery so as to narrow in a downward direction, which contacts tapered face 13,13 formed right and left latching member 12,12 which are biased at the center by springs 11,11 toward the box 10 at the ends fixed to the inner face of upper part 1*a* of body 1. When button 6 is pressed, the tapered face 9 pushes each member 12,12 in opposite directions as shown by the arrows against the resilient force of springs 11,11. If the button 6 is released, it will return to a normal position by the force of springs 11,11.

At each end of said latching members 12,12, an engaging part 14,14 (one side is shown in FIG. 3) such as the slot of a hook is formed, and two ratchets 15,15 (in FIG. 3 this part is shown rotated by 90 degrees) provided on lid 2 engage the parts 14,14. When the button 6 is pressed latching member 12,12 disengages. When lid 2 is closed, ratchet 15,15 moves the latching member 12 by engaging its inclined face and latches with latching member 12. The construction shown is symmetrical and the same on the right and left.

FIG. 2 shows an auxiliary locking mechanism 16 provided at the opening of the body 1 and lid 2 respectively. The auxiliary locking mechanism 16 comprises a locking piece 17 provided on the inner face of the upper face 1*a* and a locking piece 18 provided on the inner surface of opposite sides of lid 2. Locking piece 17 of body 1 is in the shape of a hook, formed by main rod part 17*a* secured to body 1 and in the bent part 17*b* having recess 17*c*.

Figure 4:
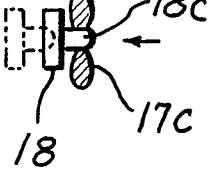
FIG. 4 is an enlarged side view of the auxiliary locking mechanism.

Locking piece 18 provided on the inside of lid 2 is made from a resilient material with the base 18*a* secured to the lid 2. The free end 18*b* extends upward to a position corresponding or opposing to recess 17*c*, and projection 18*c* (FIG. 4) on the side of free end 18*b* engages recess 17*c*. The engaged state of projection 18*c* and recess 17*c* is clearly shown in FIG. 4. If the end of projection 18*c* is pushed as shown by the arrow, the projection 18*c* is released from recess 17*c* as shown in the dashed lines and the lid 2 can open completely. Whereas in the engaged state, lid 2 can be partially opened by an amount equal to the bend of locking piece 18. Therefore it is possible to determine a suitable opening amount by selecting the length of locking piece 18. The position of locking piece 17 and 18 can be reversed if desired. The exact construction and engagement is given only as an example and other constructions are possible.

In FIG. 2, plate 9 is provided for articles stored in body 1, and the lower end of plate 19 is hinged to the lower fac 2*a* of the lid 2. A string 20 connects the free end of plate 19 and inner face of lid 2.

Operation of this device is as follows;

For opening the case, button 6 is pressed. The latching members 12,12 on the right and left move outwardly releasing parts 14,14 from ratchets 15,15 allowing lid 2 to be completely opened. However, with the lid 2 connected to body 1 by locking pieces 17,18 of auxiliary locking mechanism 16, lid 2 is opened by an amount corresponding to the length of locking piece 18, so that spilling of the articles contained in the body 1 is prevented by inadvertent complete opening of lid 2 when button 6 is pressed and any shock from partial opening of the lid 2 is absorbed by the cushioning or resilient force of locking piece 18.

For access to the articles in body 1, projection 18*c* of locking piece 18 of auxiliary mechanism 16 is disengaged from recess 17*c* of locking piece 17 so that lid 2 can be completely opened. For closing, lid 2 is closed half way until projection 18*c* engages recess 17*c* of locking piece 17, completely closing lid 2. In this position, ratchet 15 biases engaging part 14 into engagement with latching member 12.

As explained above, in this invention the auxiliary locking mechanism which locks the body and lid approximately half way open prevents inadvertent spil1ing of articles contained in the case due to complete opening of the lid when the locking mechanism or the case is released. Further, locking mechanism 5 on both sides of the case is released by one button as shown, allowing the lid to be opened by one hand for ease of operation.

Figure 5:
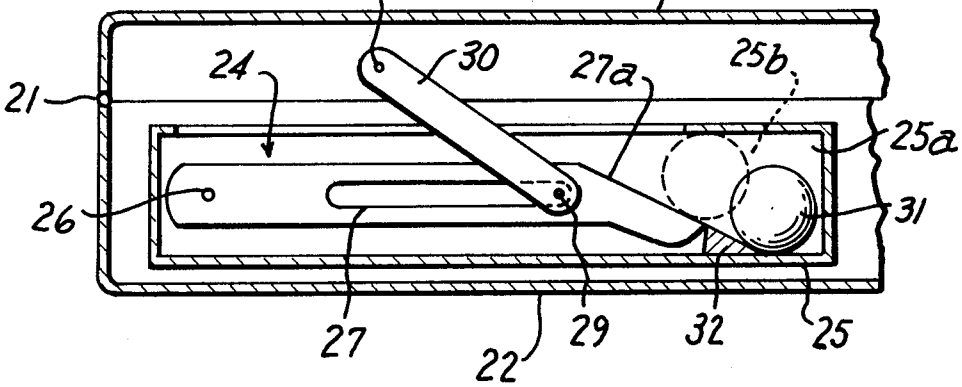
FIG. 5 is an enlarged cross sectional view of auxiliary locking mechanism according to a second embodiment of this invention.
Figure 6:
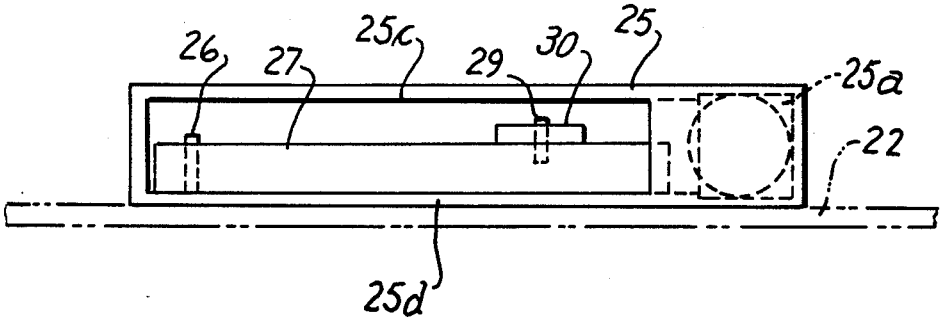
FIG. 6 is a front view of the embodiment of FIG. 5.
Figure 7:
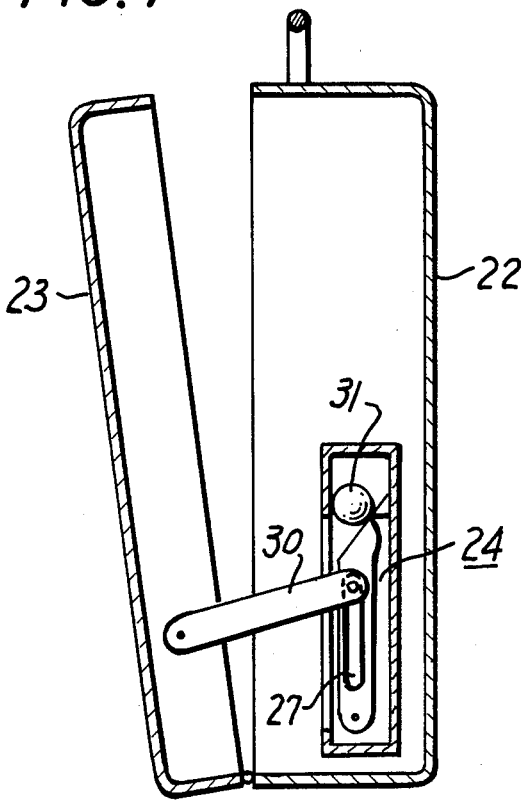
FIG. 7 is a longitudinal cross sectional view of the embodiment of FIG. 5 with the lid in a half-opened position.

Another embodiment of auxiliary locking mechanism is shown in FIGS. 5 through 7 in which body 22 and lid 23 are connected by a hinge 21 and an auxiliary locking mechanism 24. As shown in FIGS. 5 and 6, the auxiliary locking mechanism 24 is comprised of a case 25 attached to body 22, a first link 27 rotatably supported at one end in case 25 by a pin 26, a second link 30 rotatably connected to the lid 23 by pin 28 at one end, and connected to the first link 27 by a pin 29 at the other end, and a ball 31 (locking part) retained in the case 25 at the engaging end 27*a* of first link 27.

As shown in FIG. 5, the ball 31 moves to the position shown by the dotted line when the case is in a vertical position as shown in FIG. 7 engaging the end 27*a* of link 27 preventing rotation and holding lid 23 in a partially opened positioned. On the other hand, when the case is in a horizontal position as shown in FIG. 5, the ball 31 moves to the position shown by the solid line, releasing end 27*a* of link 27 allowing rotation and lid 23 can be completely opened.

As shown in FIGS. 5 and 6, a portion of upper face 25*b* of case 25 is open except the portion 25*a* where the ball 31 is contained. The first and second links 27,30 pass through the opening and ball guide 32 forms an inclincd face at the bottom of portion 25*a*. Side walls 25*c*, 25*d* of the enclosure 25 are spaced apart a distance which is approximately equal to the diameter of ball 31 at portion 25*a* only and is spaced apart a distance less than the diameter of the ball at other parts so that the ball 31 can not escape from portion 25*a*.

Operation of this device is as foows;

As shown in FIG. 7, when the case is vertical, the ball 31 of the auxiliary locking mechanism 24 moves by gravity to the end 27*a* of first link 27 and engages the ball 31. Therefore lid 23 can not open completely even if the lock of lid 23 (not shown) is released, because rotation of first link 27 is prevented. Only second link 30 can rotate allowing lid 23 to open only half way so that spilling of the articles in the case is avoided.

For opening lid 23 completely, the case is placed horizontally causing ball 31 to move to the position shown by solid line in FIG. 5, releasing end 27*a*, allowing rotation of both first and second links 27,30. It is possible to adjust the amount of opening by proper selection of the length of second link 30. It is also possible to reverse the positions of links 27,30 from the body 22 to the lid 23.

Figure 8:
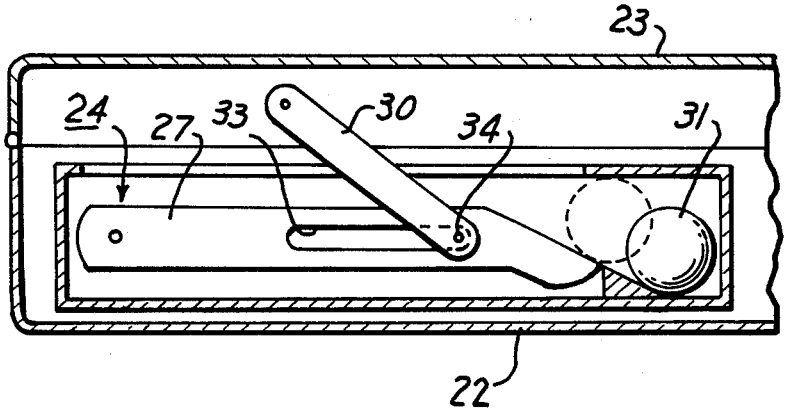
FIG. 8 is a cross sectional view of the auxiliary locking mechanism according to a third embodiment of this invention.
Figure 9:
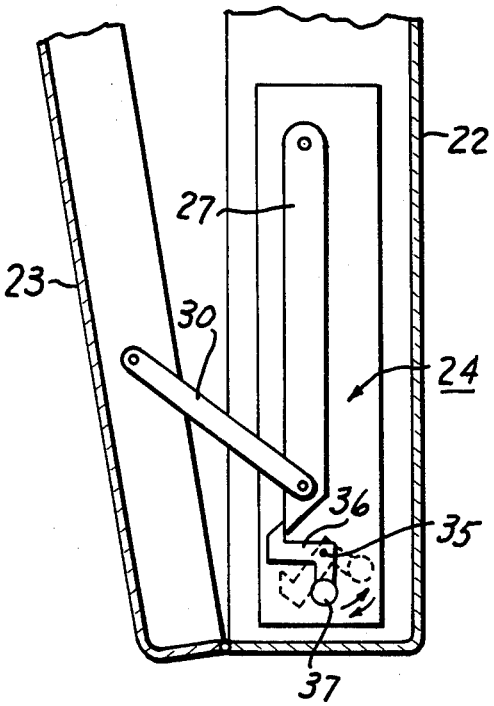
FIG. 9 is a cross sectional view according to a fourth embodiment of this invention.

Another embodiment of the auxiliary locking mechanism which is shown in FIG. 8, first link 27 and second link 30 are connected by a pin 34 and slot 33 in link 27 having the same function Still another embodiment of said auxiliary locking mechanism which is shown in FIG. 9, an L shape locking piece 36 is povoted at pin 35 on the inner wall of body 22 by a weight 37 fixed at the end of the locking piece 36 for engaging link 27. If the case is in a vertical position, the locking piece 36 is in the position shown by the solid line engaging link 37 preventing rotation of link 27. Therefore the second link 30 can only rotate to open lid 23 slightly. For complete opening of lid 23, the case is placed horizontally allowing locking piece 36 to rotate to the dotted line position releasing link 37.

As explained above, in a standing or vertical position, the case is opened only part way by the auxiliary locking mechanism so that the spilling of articles can be avoided and it is possible to open the case with one hand.

Figure 10:
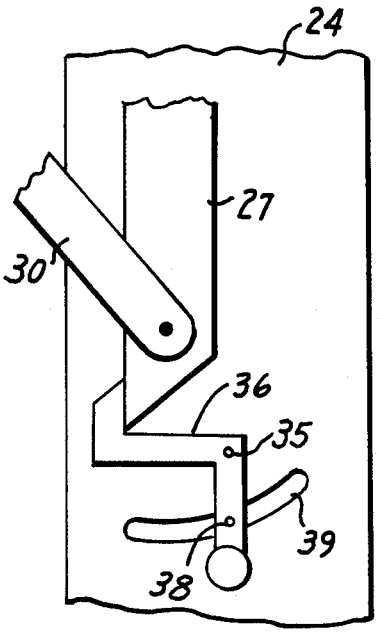
FIG. 10 is a longitudinal view of an essential part according to a fifth embodiment of this invention applied to a cupboard.

An embodiment in which this invention is applied to a drop-lid cupboard is shown in FIG. 10. First link 27, locking piece 36 are provided on an auxiliary locking mechanism 24 in the body 22 of a cupboard. The locking piece 36 is provided with an operating handle 38 extending outward through a slot 39 in body 22. Therefore a lid (not shown) can be opened from a partially opened position to a completely opened position by disengaging locking piece 36 from link 27 by operating handle 38.

As expalined above, the auxiliary locking mechanism in this invention can be applied to any case having a lid which is opened slightly or completely by the force of gravity.

This invention is not to be limited by the embodiments shown in the drawings and described in the description, which are given by way of example and not of limitation, but only in accordance with the scope fo the appended claims.

I claim:

1. In a case having a body and a hinged lid attached to the said body the improvement comprising:

first lock means in said case for locking and securing said hinged lid in a closed position;

release means for releasing said first lock means for opening said lid;

auxiliary lock means connecting said body to said hinged lid said auxiliary locking means having means for holding said hinged lid in a partially open position when said case is positioned vertically with said first lock means released; said auxiliary lock means including means for automatically releasing said holding means to allow said hinged lid to fully open when said case is shifted from said vertical position to a horizontal position.

2. The case according to claim 1 in which said auxiliary lock means includes; connecting means connecting said hinged lid to said body; said holding means comprising gravity operated means for restraining operation of said connecting means so that said hinged lid may partially open when said case is positioned vertically; said gravity operated means including means releasing said connecting means to allow said lid to fully open when said case is shifted from said vertical position to a horizontal position.

3. The case according to claim 1 in which said release means includes a handle extending outward from said case; said handle having means for tripping said release means to allow said hinged lid to move from a partially to a fully open position.

4. The case according to claim 2 in which; said connecting means includes linking means pivotally linking said hinged lid to said body; said gravity operated means including ball locking means engaging said linking means to hold said hinged lid in a partially open position when said case is in a vertical position; said ball locking means disengaging from said linking means to allow said hinged lid to fully open when said case is in a horizontal position.

5. The case according to claim 2 in which; said connecting means includes linking means pivotally linking said hinged lid to said body; latch means restricting pivotal motion of said linking means to allow said hinged lid to only partially open; and latch release means for releasing said linking means to allow release of said hinged lid from a partially open position to a fully open position.

6. The case according to claim 5 in which said latch release means includes automatic release means for automatically releasing said linking means when said case is shifted from a vertical position with said lid partially open to a horizontal position.

7. The mechanism according to claim 1 in which said auxiliary locking mechanism comprises;

resilient latching piece attached to one side of said case;

ratchet means attached to the other side of said case for engagement by said resilient latching piece;

said resilient latching piece having a length selected to allow said lid to pivot away from said body to partially open said case.

8. The mechanism according to claim 7 including projecting means on said resilient latching means which can be released to allow said case to completely open.

9. The mechanism according to claim 5 in which said release means includes a handle attached to said latch means for releasing said latch means.

10. The mechanism according to claim 6 in which said means for automatically releasing said latch means comprises a canterlevered weight on the end of said latch means which releases said latch means by the force of gravity.

* * * * *